United States Patent [19]

Hoffsommer et al.

[11] 3,979,805

[45] Sept. 14, 1976

[54] RESILIENTLY SUPPORTED BAFFLE FOR YARN TEXTURING AIR JET

[75] Inventors: Walter A. Hoffsommer, Ridley Park, Pa.; Richard J. Polney, New Castle, Del.; Samuel T. Price, Kennedyville, Md.

[73] Assignee: Enterprise Machine and Development Corporation, New Castle, Del.

[22] Filed: Mar. 20, 1975

[21] Appl. No.: 560,549

[52] U.S. Cl. ..... 28/1.4

[51] Int. Cl.[2] ..... D02G 1/16

[58] Field of Search ..... 28/1.4, 72.12; 57/140, 57/77.3, 34 B

[56] References Cited

UNITED STATES PATENTS 3,835,510 9/1974 Koslowski ..... 28/1.4

3,881,232 5/1975 Price et al. ..... 28/1.4

*Primary Examiner*—Louis K. Rimrodt

*Attorney, Agent, or Firm*—Bell, Seltzer, Park & Gibson

[57] ABSTRACT

This resonant baffle comprises a relatively thin rectangular plate which extends transversely of and is spaced from the exit orifice of the air jet. The baffle is hingedly supported for movement toward and away from the exit orifice and a leaf spring normally urges the baffle toward the exit orifice of the air jet. An adjustable stop screw is provided for limiting inward movement of the baffle. This resonant baffle permits higher operating speed, provides better integration and more uniform loop formation along the length of the textured yarn.

9 Claims, 3 Drawing Figures

RESILIENTLY SUPPORTED BAFFLE FOR YARN TEXTURING AIR JET

Figure 1:
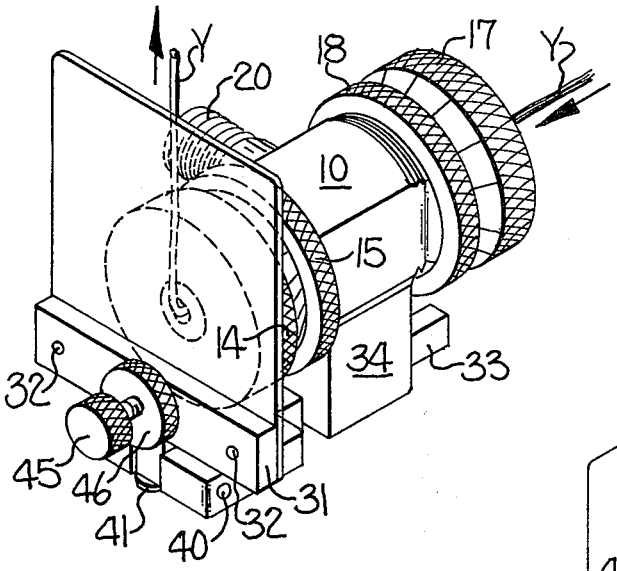

This invention relates generally to a yarn texturing air jet and particularly to a resiliently supported resonant baffle for controlling the amount of air which echoes back into the turbulent chamber of the jet to thereby vary the harmonic frequency and resonance so that the normal turbulence in the chamber is sufficiently increased so as to enhance the crimps, curls and loops produced in the filaments of the yarn and to permit faster and more economical operation.

It is generally known to utilize various types of baffle plates at the exit end of yarn texturing air jets. These plates have been positioned at various distances from the exit end of the jet and at various angles to the yarn path to deflect the yarn and the air from a straight line path. These plates are normally supported in a fixed position relative to the jet during operation. U.S. Pat. No. 3,835,510 discloses a "free floating" baffle plate which is positioned adjacent to the outlet or exit end of the jet for free movement towards and away from the outlet end. The air escaping from the exit end of the jet creates a low pressure area between the outlet of the jet and the planar surface of the baffle so that atmospheric pressure on the side of the baffle remote from the jet forces the baffle toward the jet until it reaches an equilibrium position under the influence of the forces exerted by the air and yarn against the side of the baffle near the jet. One embodiment disclosed in this patent illustrates the baffle plate being hingedly supported for swinging free movement toward and away from the jet.

With the foregoing in mind, it is an object of the present invention to provide a resonant baffle for a yarn texturing air jet which extends transversely across and is spaced a predetermined distance from the exit orifice of the air jet and is hingedly supported for movement toward and away from the air jet with resilient means normally maintaining the baffle the predetermined distance from the exit end of the air jet and adjustable stop means for limiting inward movement of the resonant baffle toward the exit orifice.

In accordance with the present invention, the resonant baffle comprises a relatively thin rectangular plate which is hingedly supported below the exit orifice and a leaf spring cooperates with the hinge connection to normally maintain the resonant baffle a predetermined distance from the air jet. An adjustment screw is provided to limit inward movement of the resonant baffle toward the exit end of the air jet. The resonant baffle operates to cause some of the energy of the pressurized air to echo back into the turbulent chamber of the jet and to thereby vary the normal resonance and increase the turbulence in the turbulent texturing chamber of the air jet. Since the baffle is resiliently supported in a particular spaced position from the exit of the air jet, spaced position can automatically vary to control the harmonic frequency of the vibrations which are sent echoing back into the chamber so that the most efficient use of the air pressure can be obtained. Thus, the resiliently supported baffle will be automatically adjusted to take care of small variations in tension, air pressure, and yarn variations.

Figure 2:
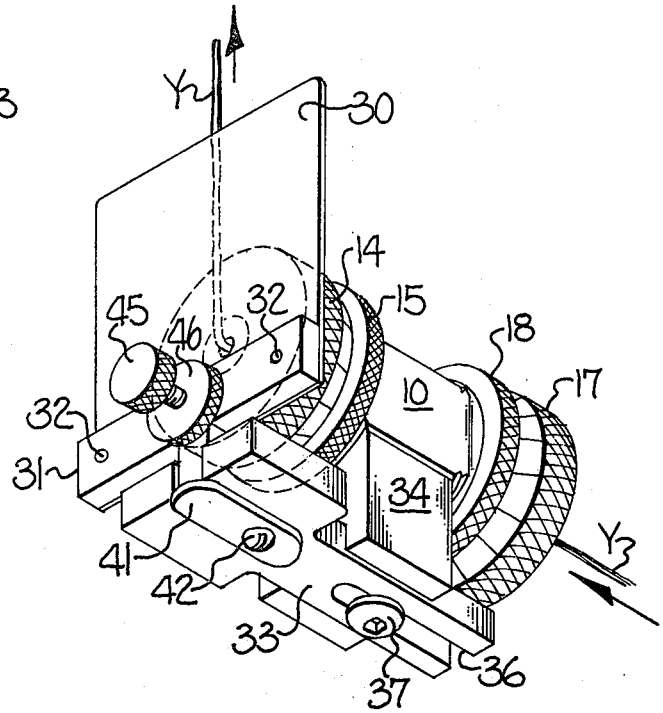
Figure 3:
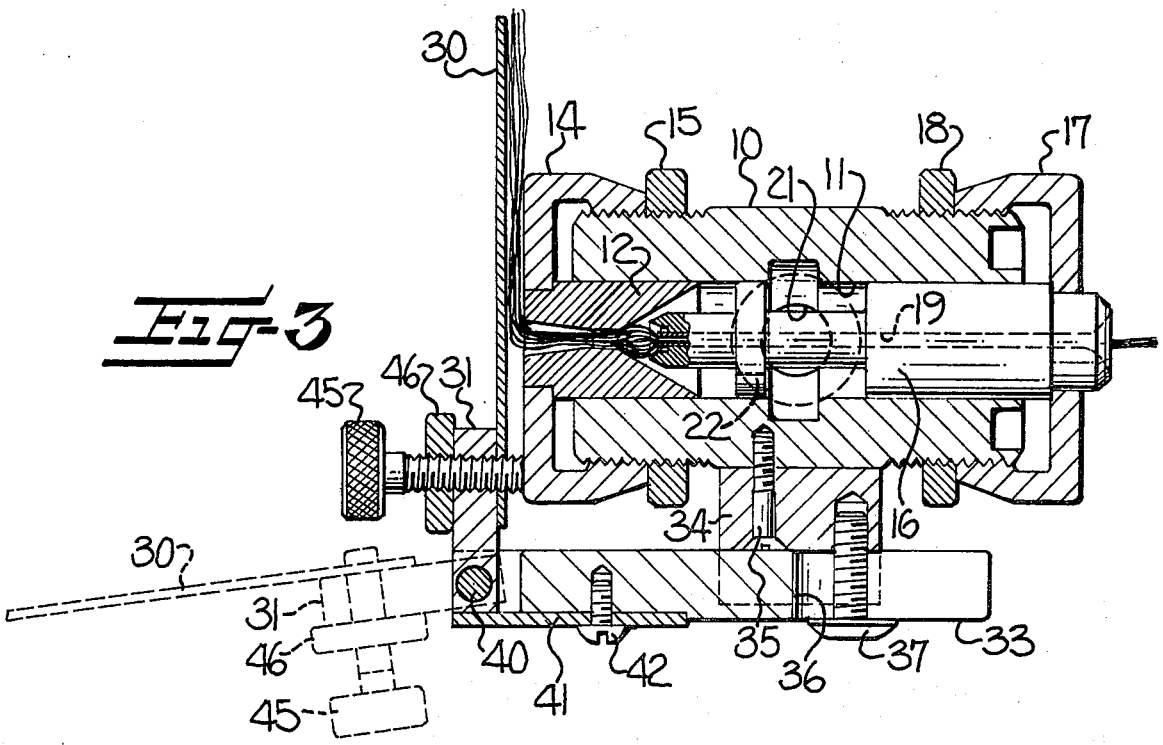

Other objects and advantages will appear as the description proceeds when taken in connection with the accompanying drawings, in which FIG. 1 is an isometric view looking downwardly on the air texturing jet and illustrating the resiliently supported baffle of the present invention positioned across the exit end of the air jet;

FIG. 2 is a view similar to FIG. 1 but looking upwardly to show the lower portion of the air jet; and FIG. 3 is an enlarged vertical sectional view through the air jet and baffle to show the relative position of the baffle and the exit end of the air jet.

The resiliently supported baffle of the present invention will be described in connection with a particular type of yarn texturing air jet, however, it is to be understood that the present resonsant baffle may be used with other types of yarn texturing air jets. It has been found that a wide range of yarn denier sizes can be textured at greatly increased rates of speed with the use of the baffle of the present invention. In all deniers of yarn, the baffle provides more uniform loops, crimps or curls in the yarn and appears to eliminate or substantially reduce the tendency of the air jet to form large loops and small loops along various portions of the length of the yarn.

In texturing yarns in the range of 150 to 300 denier, it has been found that the loops are smaller and the yarn is uniformly consolidated along its length. Surprisingly, when used to texture yarn above 1,000 denier, the loops, crimps and curls appear to take on a larger configuration to thereby increase the bulk in the yarn. However, in the larger denier yarns the loops are also of uniform size throughout the length of the yarn. The resiliently supported baffle automatically adjusts itself for small variations in tension in the exiting yarn to give uniform tension to the yarn as it leaves the air jet. The leaf spring acts to damp out vibrations of the baffle plate and this is believed to contribute to the uniform texturing of the yarn.

The yarn texturing air jet illustrated in the drawings includes an elongate housing 10 having a central bore 11 extending therethrough and from the entrance end to the exit end of the air jet. A venturi 12 is supported for longitudinal adjustment in the central bore 11 and in the exit end of the housing 10 and is provided with an inward tapering conical surface on the inner or entrance end to define the exit end of a turbulent chamber. The outer end portion of the venturi 12 is fixed in a venturi cap 14 which is threadably supported on the threaded exit end portion of the housing 10 so that the venturi 12 may be longitudinally adjusted along the central bore 11 by rotation of the venturi cap 14. A lock ring 15 is threadably supported on the threaded exit end portion of the housing 10 and adjacent the venturi cap 14 so that the venturi 12 may be locked in adjusted position.

A yarn guiding needle 16 is positioned in the central bore 11 of the housing 10 and its outer or entrance end is fixed in a needle support cap 17 which is threadably supported on the threaded entrance end portion of the housing 10 so that the needle 16 may be longitudinally adjusted along the central bore 11 by rotation of the needle support cap 17. A lock ring 18 is threadably supported on the threaded entrance end portion of the housing 10 and adjacent the needle support cap 17 so that the needle 16 may be locked in adjusted position.

An axial yarn guiding channel 19 extends throughout the length of the needle 16 for directing multifilament yarn through the needle 16 and through the venturi 12. An air inlet pipe 20 is connected to the housing 10 for directing pressurized gas or air into the central bore 11 of the housing 10. The air jet enters the central bore 11 through a bore 21 (FIG. 3) and is directed through one or more air passageways 22 in a flange on the needle 16. The air passing through the passageways 22 is distributed in the turbulent chamber or zone provided between the exit end of the needle 16 and the entrance end of the venturi 12.

The multifilament yarn Y enters the entrance end of the air jet and passes through the axial yarn guiding channel 19 of the needle 16, through the turbulent chamber defined between the inner or exit end of the needle 16 and the entrance end of the venturi 12, through the venturi 12 and is then directed upwardly and at a right angle from the exit end of the air jet. The yarn Y is wound onto a suitable take up package, not shown. As is well known, the yarn is usually fed through the jet with some percentage of overfeed, that is, the rate at which the yarn is fed into the air jet is somewhat greater than the rate at which it is withdrawn from the air jet to permit the formation of crimps, curls and loops in the yarn as the turbulent air engages the filaments of the yarn in the turbulent chamber. While only a single yarn is illustrated in the drawings, as being uniformly textured throughout its length, it is to be understood that so-called core and effect yarns or slub yarns can also be textured in this type of air jet. It is also possible to texture single or parallel ends of yarn and the resiliently supported baffle of the present invention provides advantages when texturing yarns in accordance with any of the known processes.

In accordance with the present invention, means is provided for increasing the turbulence of air in the turbulent chamber of the air jet and for enhancing the crimps, curls, and loops imparted to the yarn so that the yarn may be economically processed at a greater rate of speed and to provide more uniform loop formation and better integration of loops throughout the length of the yarn. To this end, a resonant baffle, in the form of a relatively thin rectangular plate 30 is provided. The plate 30 includes a substantially planar face which is spaced a predetermined distance from the exit end of the venturi 12 and extends transversely across the exit end.

Means is provided for hingedly supporting the baffle plate 30 for swinging movement toward and away from the exit orifice and includes a T-shaped bracket 31. The bracket 31 includes a horizontal portion which is fixed to the lower portion of the plate 30 by screws 32 and a vertical leg which extends downwardly from the horizontal portion.

A support plate 33 extends beneath and parallel to the housing 10 and the rear end portion of the support plate 33 is supported for longitudinal adjustment on a support bracket 34 which is fixed, as by a screw 35 (FIG. 3), to the lower portion of the housing 10. The rear portion of the support plate 33 is slotted, as at 36 and a screw 37 penetrates the slot 36 and is threaded into the support block 34 so that the support plate 33 may be fixed in the longitudinal adjusted position.

The forward end portion of the support plate 33 is bifurcated to receive the vertical leg of the T-shaped bracket 31 and a hinge pin 40 is supported at opposite ends in the bifurcated forward end of the support plate 33. The medial portion of the hinge pin 40 penetrates the vertical leg of the T-shaped bracket 31 to hingedly support the bracket 31 and the baffle plate 30 thereon.

Resilient means is provided for normally maintaining the resonant baffle plate 30 a predetermined distance from the exit end of the air jet and includes a leaf spring 41 having forward and rear end portions with the rear end portion being fixed on the support plate by a screw 42. The forward end portion of the leaf spring 41 extends beneath the flat bottom of vertical leg of the T-shaped bracket 31 and is operable to normally maintain the resonant baffle plate 30 in an upright position with the face a predetermined distance from the exit end of the air jet determined by the adjustment of the support plate 33.

Adjustable stop means is provided for limiting inward movement of the resonant baffle plate 30 towards the exit orifice of the air jet and includes a threaded adjustment screw 45 which threadably penetrates the bracket 31 and the lower portion of the resonant baffle plate 30 so that the inner end thereof engages the end face of the venturi cap 14. A lock ring 46 is provided on the threaded adjustment screw 45 to lock the screw 45 in adjusted position.

Depending upon the size and type of yarn being textured, the longitudinal position of the support plate 33 and the threaded adjustment screw 45 may be adjusted so that the inner limit of movement of the baffle plate 30 is positioned the desired distance from the exit end of the air jet. The yarn Y may be threaded through the air jet, while the baffle plate 30 is swung down to the inoperative dotted line position shown in FIG. 3. After the yarn Y is threaded through the air jet, the resonant baffle plate 30 may be swung up to the solid line or active position shown in FIG. 3 so that the leaf spring 41 resiliently maintains the plate 30 at a predetermined distance from the exit end of the air jet while the threaded adjustment screw 45 positively limits inward movement of the resonant baffle plate 30.

As the air and yarn leave the air jet, the baffle plate 30 causes some of the energy of the air pressure to echo back into the texturing chamber of the air jet to set up vibrations of the proper harmonic frequency in the chamber to provide a more uniform loop formation throughout the length of the yarn. This action provides better integration of loops and enhanced crimps, curls and loops are obtained in the filaments of the yarn so that the yarn may be textured at a greater than normal texturing speed. The leaf spring 41 damps out baffle plate vibrations and aids in providing uniform tension in the exiting yarn.

The resonant baffle plate 30 appears to function as a "butter spreader" to reduce the normal peaks and valleys which normally occur in the texturing chamber of the air jet to thereby improve the bulking action and control the uniformity of the yarn product. The adjustment of the baffle 30 permits the optimum harmonic frequency to be set up in the texturing chamber so that the yarn can be textured at a fast rate. Also, any small variations which might normally occur in the yarn because of variations in tension, air pressure, or yarn characteristics are automatically adjusted for because the leaf spring 41 resiliently maintains the baffle plate 30 a predetermined distance from the exit end of the air jet.

Although resonant baffle plates of other sizes and shapes may be employed, it has been found that a plate which is 2¼ inches high, 1¾ inches wide and 1/16 inch thick provides suitable texturing for a wide range of yarn deniers and sizes.

In the drawings and specifications, there has been set forth a preferred embodiment of the invention, and although specific terms are employed, they are used in a generic and descriptive sense only and not for purposes of limitation.

That which is claimed is:

1. In a yarn texturing air jet of the type including an elongate housing having a central bore therethrough, an entrance opening at one end and an exit orifice at the other end for directing yarn through said central bore in said housing, a turbulence chamber in said central bore, and means for directing pressurized air into said turbulence chamber and outwardly through said exit orifice to impart crimps, curls and loops to the yarn passing through said turbulence chamber, the combination therewith of means for increasing the turbulence of air in said turbulence chamber and enhancing the crimps, curls and loops imparted to the yarn, said means comprising a. a resonant baffle including a substantially planar face extending transversely across and spaced a predetermined distance from said exit orifice, b. means hingedly supporting said resonant baffle for movement toward and away from said exit orifice, and c. resilient means normally maintaining said resonant baffle said predetermined distance from said exit orifice.

2. A yarn texturing air jet according to claim 1 including adjustable stop means for positively limiting inward movement of said resonant baffle toward said exit orifice.

3. A yarn texturing air jet according to claim 2 wherein said adjustment stop means comprises a threaded adjustment screw threadably penetrating the lower portion of said plate and having an inner end portion engageable with the exit end of said housing.

4. A yarn texturing air jet according to claim 1 wherein said resonant baffle comprises a relatively thin rectangular plate, wherein the yarn leaving said exit orifice is directed upwardly therefrom to pass between said plate and the exit end of said housing, and wherein said hinge support means is positioned below said exit orifice to hingedly support the lower portion of said plate.

5. A yarn texturing air jet according to claim 4 wherein said hinge support means includes a support plate extending beneath and parallel with said housing, said support plate including forward and rear end portions with said plate being hingedly supported on said forward end portion, and means supporting said rear end portion of said support plate on a medial portion of said housing.

6. A yarn texturing air jet according to claim 5 wherein said resilient means comprises a leaf spring including forward and rear end portions with said rear end portion being fixed on said support plate, and said forward end portion of said leaf spring being operable to maintain said plate a predetermined distance from said exit orifice.

7. A yarn texturing air jet according to claim 6 including a T-shaped bracket comprising a horizontal portion fixed to the lower portion of said plate and a vertical leg extending downwardly therefrom, said forward end portion of said support plate being bifurcated to receive said vertical leg of said T-shaped bracket, and including a hinge pin supported at opposite ends in said bifurcated forward end portion of said support plate with the medial portion of said hinge pin penetrating said vertical leg of said T-shaped bracket to hingedly support the same thereon.

8. A yarn texturing air jet according to claim 7 including means adjustably supporting said rear end portion of said support plate on said supporting means for forward and rearward adjustment of said support plate.

9. A yarn texturing air jet according to claim 8 including adjustable stop means for limiting inward movement of said plate toward said exit orifice, said adjustable stop means comprising a threaded adjustment screw threadably penetrating said horizontal portion of said T-shaped bracket and the lower portion of said plate and having an inner end portion engageable with the exit end of said housing.

* * * * *